US006564856B1

(12) United States Patent
Buckley

(10) Patent No.: US 6,564,856 B1
(45) Date of Patent: May 20, 2003

(54) METHOD OF MAKING PRECISION CASTINGS USING THIXOTROPIC MATERIALS

(75) Inventor: James A. Buckley, Whitefish Bay, WI (US)

(73) Assignee: Chipless Metals LLC, Mequon, WI (US)

( * ) Notice: Subject to any disclaimer, the term of this patent is extended or adjusted under 35 U.S.C. 154(b) by 0 days.

(21) Appl. No.: 09/529,647

(22) PCT Filed: Oct. 19, 1998

(86) PCT No.: PCT/US98/22048

§ 371 (c)(1),
(2), (4) Date: Apr. 17, 2000

(87) PCT Pub. No.: WO99/20417

PCT Pub. Date: Apr. 29, 1999

Related U.S. Application Data

(60) Provisional application No. 60/062,582, filed on Oct. 20, 1997.

(51) Int. Cl.[7] ..... B22D 29/00; B22D 27/00

(52) U.S. Cl. ..... 164/132; 164/120; 164/72

(58) Field of Search ..... 164/80, 120, 72, 164/420

(56) References Cited

U.S. PATENT DOCUMENTS

| | | | | |
|---|---|---|---|---|
| 1,544,930 A | | 1/1925 | Pack | |
| 1,662,354 A | | 3/1928 | Williams | |
| 1,710,534 A | | 4/1929 | Field | |
| 2,609,576 A | | 9/1952 | Roush et al. | |
| 3,258,816 A | * | 7/1966 | Rearwin | 22/168 |
| 3,595,301 A | | 7/1971 | Bauer | |
| 3,847,204 A | | 11/1974 | Frederickson | |

FOREIGN PATENT DOCUMENTS

| | | |
|---|---|---|
| GB | 334714 | 9/1930 |
| GB | 2 183 516 | 6/1987 |
| JP | 52-14521 | 2/1977 |
| JP | 53-46438 | 4/1978 |
| JP | 63-199060 | 8/1988 |
| JP | 03-294055 | 12/1991 |

OTHER PUBLICATIONS

Semi Solid Metal (SSM) Forming—A New Way to Produce Small Parts, Formcast, Inc., Jan. 1998.

Jakobson, Saba, et al., "Zinc Anodizing," *Metal Finishing*, pp. 114–118, Jun. 1998.

*Primary Examiner*—M. Alexandra Elve
*Assistant Examiner*—Kim McHenry
(74) *Attorney, Agent, or Firm*—Boyle Fredrickson Newholm Stein & Gratz S.C.

(57) ABSTRACT

Precision castings, such as brake calipers and other parts requiring a fine finish and having complex internal geometries, can be produced by casting a shot of a semi-solid thixotropic metal alloy about a core, preferably a hot-chamber die-cast core, having a lower melting point than the solid-to-semi-solid transition temperature of the thixotropic alloy. Then, after the shot solidifies to form a casting with a captured core, the core is melted from the casting in a liquid bath, in an air furnace, or during other heat treatment of the part. The process dramatically reduces or even eliminates machining requirements for cast metal parts because the inner surface of the casting is of extremely low porosity and meets stringent tolerance requirements and because the melt-away core can be formed with protrusions that prevent mechanical removal of the core from the casting and that form undercuts, threads, bores, etc. in the casting. Process robustness, speed, and versatility can be enhanced by coating the core with a thin, uniform, abrasion-resistant, and thermally resistant coating that prevents excessive heat from being transferred to the core from the shot and that prevents the core from alloying with the casting.

(List continued on next page.)

59 Claims, 7 Drawing Sheets

U.S. PATENT DOCUMENTS 3,964,541 A * 6/1976 Brunner ..... 164/323
4,085,792 A * 4/1978 Eberle ..... 164/72
4,574,451 A 3/1986 Smashey et al.
4,687,042 A * 8/1987 Young ..... 164/80
5,263,531 A * 11/1993 Drury et al. ..... 164/113
5,355,933 A * 10/1994 Voss ..... 164/120
5,404,931 A * 4/1995 Anzai et al. ..... 164/420
5,501,748 A 3/1996 Gjestland et al.
5,524,698 A * 6/1996 Chen et al. ..... 164/72
5,630,466 A 5/1997 Garat et al.
5,832,982 A 11/1998 Williams et al.
6,024,159 A 2/2000 Woycik et al.

* cited by examiner

METHOD OF MAKING PRECISION CASTINGS USING THIXOTROPIC MATERIALS

CROSS REFERENCE TO A RELATED APPLICATION

Domestic Priority is hereby claimed under 35 USC §119 (e) on U.S. Provisional Application Serial No. 60/062,582, filed Oct. 20, 1997 in the name of the present inventor and entitled "METHOD OF MAKING PRECISION CASTINGS USING THIXOTROPIC MATERIALS."

BACKGROUND OF THE INVENTION

1. Field of the Invention

The invention relates to precision casting processes and, more particularly, relates to a process of casting a semi-solid thixotropic metal alloy material about a core at a temperature above the melting point of the core material and of subsequently melting the core from the casting.

2. Discussion of the Related Art

The typical cast metal part is formed in coreless dies or in dies with cores that must be mechanically removed from the part after casting. Of course, the mechanical removal requirement severely limits the range of core uses. The core cannot be formed with protrusions or other complex shapes that would form undercuts, threads, bores, etc. in the casting because the protrusions on the core would prohibit its subsequent mechanical withdrawal from the casting. As a result, threads, bores, undercuts, etc. must be machined into the cast part after casting and core removal at considerable expense to the manufacturer. In fact, post-casting machining costs often represents 50% to 75% of the cost of a finished precision-cast part having complex internal shapes.

Some of these problems could be alleviated if a suitable dissolvable core were to be used in a casting process. Currently, the investment casting process, also known as the "lost wax" process, comes close to meeting this goal. However, parts formed by this process can have complex external shapes, but not complex internal shapes. They also usually require grinding, polishing, or other secondary machining operations for fine features such as threads, bores, and seal grooves. Other processes, which cast a metal shot about a sand or salt core and subsequently remove the core by flushing it from the resultant casting, also come close to meeting this goal, but also require secondary finishing operations to meet tolerances for their finer features. Parts formed from these other processes also tend to have high internal porosity. This porosity is a problem in applications such as brake calipers in which the part needs to be precise and also hold a hydraulic pressure. It also prevents heat treatment because the trapped gases in the pores blister the casting during heat treatment. It is also quite expensive.

Melt-away core casting processes have been proposed in which a metal part is cast about a core formed from a metal having a lower melting point than the melting point of the metal casting and in which the core is subsequently melted away. See, e.g., U.S. Pat. No. 1,544,930 to Pack; U.S. Pat. No. 3,258,816 to Rearwin; U.S. Pat. No. 5,263,531 to Drury et al.; and U.S. Pat. No. 5,355,933 to Voss. In each of those processes, a fully-molten aluminum-alloy metal is cast about a zinc-alloy core, and the zinc-alloy core is removed from the part, e.g., by subsequent heat treatment of the aluminum-alloy part. Drury et al. and Voss additionally disclose that their processes are applicable to complex cores so as to produce parts having complex internal shapes. However, all of these processes exhibit disadvantages severely limiting their range of practical applications.

Most notably, in all of the melt-away core casting processes described above, great care must be taken to avoid melting the core during the casting process. This is understandable because a great deal of heat is available for transfer to the core from the molten metal of the shot, and extreme measures must be taken to insulate the core from this heat or to prevent this heat transfer from melting the core. For instance, Pack's process appears to be limited to castings having simple undercuts and hence not requiring complex cores. Rearwin and Voss require the application of a layer of insulating material such as Vermiculite to at least those parts of the core that are relatively thin when compared to the cast metal part in order to prevent the core from melting during the casting process. Drury et al. discloses chilling its core to approximately −300° F. prior to casting in order to prevent over-heating of the core during casting. Moreover, it is believed that all of these melt-away core casting processes are limited to applications in which 1) the core is relatively massive when compared to the casting, and 2) liquid metal injection takes place at relatively low pressures and at relatively low shot flow velocities.

The need therefore remains for a versatile melt-away core casting process that can form precision castings economically and with high repeatability.

OBJECTS AND SUMMARY OF THE INVENTION

It is therefore a principal object of the invention to provide a process for producing precision castings that have complex internal geometries and that require little or no machining of their interior surfaces after core removal.

A second object of the invention is to provide a process that meets the first principal object and that is highly repeatable.

A third object of the invention is to provide a process that meets the first principal object and that does not place unnecessary restraints on production.

A fourth object of the invention is to provide a process that meets the first principal object and that can be practiced economically.

In accordance with a first aspect of the invention, these objects are achieved by providing a method of obtaining precision castings by casting a shot of a semi-solid thixotropic alloy, such as a thixotropic aluminum alloy, about a casting core formed from a metal having a melting point lower than the solid-to-semi-solid transition temperature of the thixotropic alloy. The thixotropic alloy, having relatively little thermal energy, solidifies rapidly, attaining a precision shape. After the thixotropic material solidifies, the core is melted out in a subsequent heating process, leaving a precision-formed part requiring no machining. The process is applicable to a wide variety of casting processes, particularly processes producing precise parts that must contain hydraulic fluid under pressure, as is found in hydraulic brake calipers and the like. The process is also well-suited for producing cast parts of high tolerance that are essentially non-porous.

A second principal object of the invention is to provide a heat treatable cast metal part produced by a method performed in accordance with the first principal object and therefore exhibiting excellent tolerance and porosity characteristics without having to be machined. In fact, the casting is suitable for use as a brake caliper after it has been cooled and heat treated.

A third principal object is to provide a method of melting a metal core from a cast metal part.

In accordance with this object, a combination of a cast metal part and a metal core are heated together to a core melting temperature that is above the melting point of the core material but beneath the solid-to-semi-solid transition temperature of the thixotropic alloy of the casting. Preferably, heating occurs in a liquid bath designed to achieve only slight positive or negative buoyancy of the liquid metal from the core relative to the liquid of the bath. This slight buoyancy maximizes the potential for surface tension in the liquid core material to pull all of the liquid core material away from the casting.

Other objects, features, and advantages of the present invention will become apparent to those skilled in the art from the following detailed description and the accompanying drawings. It should be understood, however, the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION OF THE PREFERRED EMBODIMENTS

1. Resume

Figure 1A:
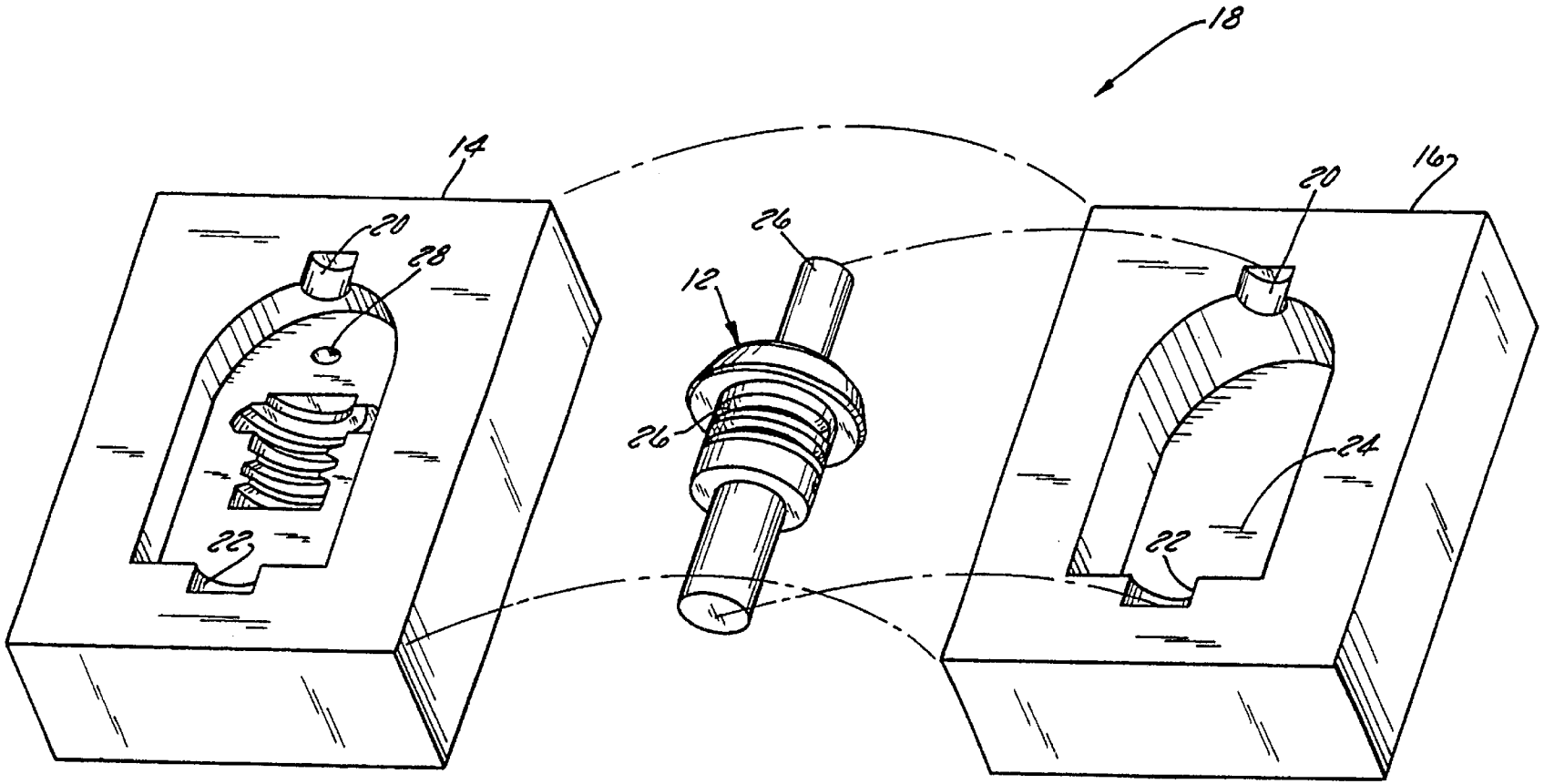
FIG. 1A is an exploded perspective view illustrating the insertion of a core in a die in accordance with the present invention.

Pursuant to the invention, precision castings such as brake calipers and other cast metal parts requiring a fine finish and having complex internal geometries can be produced by casting a shot of a semi-solid thixotropic metal alloy about a metal core, preferably a hot-chamber die-cast core, having a lower melting point than the solid-to-semi-solid transition temperature of the thixotropic alloy. Then, after the shot solidifies to form a casting with a captured core, the core is melted from the casting/core combination in a liquid bath, in an air furnace, or during other heat treatment of the casting. The process dramatically reduces or even eliminates machining requirements for cast metal parts because the inner surface of the casting is of extremely low porosity and meets stringent tolerance requirements and because the melt-away core can be formed with protrusions and indentations that prevent mechanical removal of the core from the part and that form undercuts, threads, bores, passages, etc. in the part. Process robustness, speed, and versatility can be enhanced by coating the core with a thin, uniform, abrasion-resistant, and thermally resistant coating that prevents excessive heat from being transferred to the core from the shot and that prevents the core from alloying with the casting.

2. Process Overview

An understanding of the present invention begins with an understanding of the characteristics of thixotropic metal alloys and of the semi-solid casting process that can be used to cast such alloys. A thixotropic metal alloy is a multi-component (typically bi-metal or tri-metal) alloy capable of forming a casting that has extreme ductility in comparison to traditional die castings, which are very brittle. Another major advantage of thixotropic alloys, and one having particular applicability to the present invention, is that they can be cast or otherwise formed in a semi-solid phase. This is because one metal of the alloy, forming the minority of the alloy by volume, melts before the other metal(s) forming a majority of the alloy's volume. As a result, a thixotropic alloy ingot can be cast in a semi-solid phase in which it retains its shape and can be handled but is very soft and, in fact, can be cut with a butter knife. When in its semi-solid phase, a thixotropic alloy has the unique property of exhibiting highly liquid-flow characteristics when it is subject to shear. As a result, a thixotropic alloy shot fills a mold remarkably well during a casting process—better than a conventional molten liquid material in most ways—because the shot enters the mold as a wave front rather than as a spray and does not trap any gas. The resultant casting is pore-free and, unlike traditional die castings formed from liquid shots, can be heat treated without blistering. Because of these and other advantageous characteristics, casting of thixotropic alloys can yield a material with the quality of a forging. Depending upon the characteristics and relative percentage of the constituent metals of the alloy, a thixotropic alloy shot may be castable with anywhere from 50% to 85% of its volume in the solidus phase. A wide and ever growing range of thixotropic metal alloys are available including 1) thixotropic aluminum alloys, 2) thixotropic magnesium alloys, 3) thixotropic zinc alloys, 4) thixotropic bronze alloys, and 5) thixotropic brass alloys. Thixotropic alloys and their methods of production are discussed generally, for example, in U.S. Pat. No. 5,630,466 to Garrett et al. and U.S. Pat. No. 5,501,748 to Gjestland et al., the disclosures of both of which are hereby incorporated by reference by way of background information. Semi-solid metal forming processes for forming metal parts from thixotropic alloys are discussed, for example, in *Semi Solid Metal* (*SSM*) *Forming A New Way to Produce Small Parts*, Formcast, Inc., January, 1998, the disclosure of which is also incorporated by way of background information.

At the heart of the present invention is the realization that a shot of a semi-solid thixotropic metal alloy transfers much less heat energy to its surroundings during a casting process than is transferred by a liquid shot of the same temperature. This reduction in heat transfer is due to the fact that a semi-solid shot exhibits only a relatively small latent heat of solidification (also known as "latent heat of fusion") because the majority of its volume is in the solidus phase rather than the liquidous phase. For instance, a thixotropic aluminum alloy having 60% solid phase by volume, which is standard for thixotropic aluminum, carries one-half of the heat energy of a similar shot of molten aluminum at the same temperature and, hence, impinges the core with 50% less thermal energy when the shot is cast into the mold under identical conditions. Of course, thixotropic materials having a higher solid percentage by volume would impinge the core with commensurately less energy. Therefore, all other factors being equal, a thixotropic alloy having a maximum-available solid percentage should be used in the inventive process to minimize the latent heat of solidification.

The basic benefits of the invention may best be understood via description of the casting of a hypothetical part 10 as illustrated in FIGS. 1A through 1D. The part 10 is obtained by injecting a semi-solid shot of thixotropic alloy around a metal core 12 in a pair of mating dies 14, 16 of a mold 18. The mating dies 14, 16 are metal dies such as are known in the aluminum die casting industry. While the dies 14, 16 of the illustrated embodiment are formed from steel, it should be understood that the die materials will vary from application-to-application, depending upon the properties of the metal being cast.

To cast the part 10, the core 12 is inserted in datums 20 and 22 within the dies 14 and 16 as seen in FIG. 1A to precisely locate the part 10 within the dies 14 and 16. The mold 18 is then closed to form a die cavity 24 between the core 12 and the inner surfaces of the dies 14 and 16.

The core 12 is preferably formed from of a low-melting temperature alloy with a melting point lower than the solid-to-semi-solid transition temperature of the thixotropic alloy. For instance, if the thixotropic alloy is an aluminum 356 T6 alloy injectable at a temperature of about 1080° F. to 1090° F., the core 12 should preferably be a zinc alloy having a melting point of more than approximately 700° F. Suitable zinc alloys for the example include AcuZinc 5, ZAMAK 3 (ASTM AG 40A1), and ZAMAK 5 (ASTM AC41A), or another alloy that has a relatively low melting point and that is structurally stable, castable, and recyclable (a more detailed discussion of core and casting material selection criteria is provided in Section 3 below). The core 12 incorporates protrusions 26 capable of forming all internal passages, seal grooves, threads, and other internal features of the casting 10.

Figure 1B:
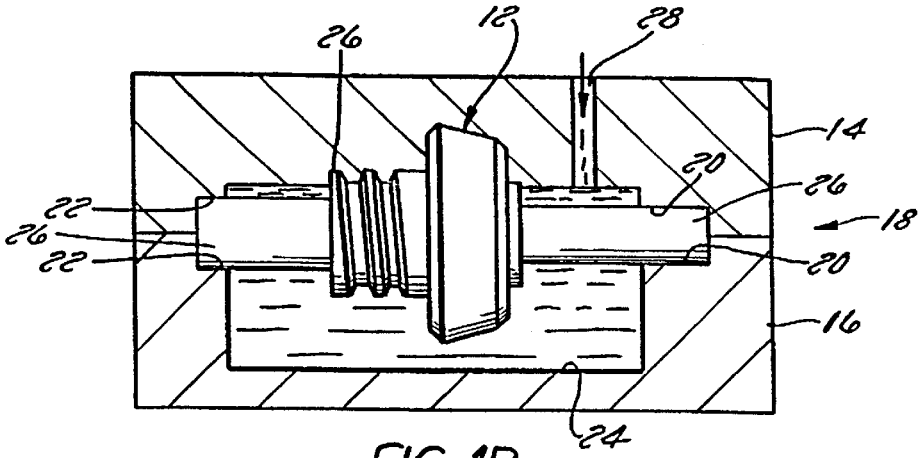
FIG. 1B is a sectional side elevation view illustrating the casting of a part within the die of FIG. 1A.
Figure 1C:
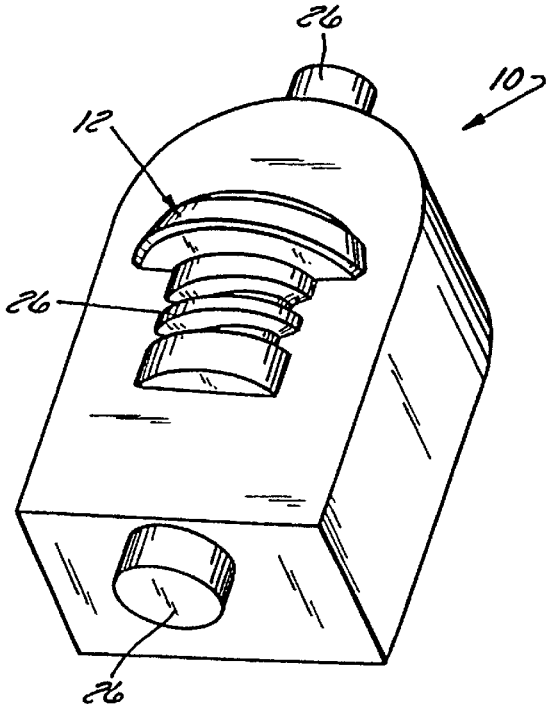
FIG. 1C is a perspective view illustrating the cast part/core combination after the casting process but prior to core melting.
Figure 1D:
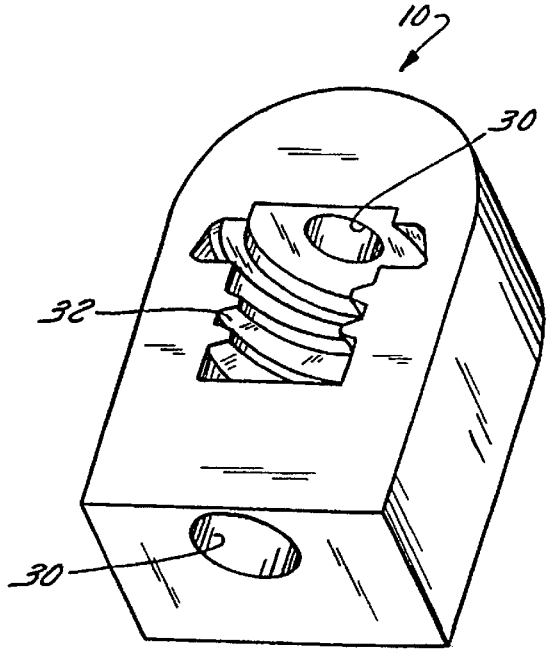
FIG. 1D illustrates the finished precision-cast part formed after melting the core from the composite part of FIG. 1C.

Next, a thixotropic alloy ingot is heated to its semi-solid-state and rammed into the die cavity 24 from an inlet port 28 of the mold 18 using conventional aluminum die casting technology. In the case of a thixotropic alloy formed from 356 T6 aluminum, the alloy is injected into the die cavity 24 at a temperature of about 1080° F. to 1090° F., at which point it is about 60% solid and only about 40% liquid. The thixotropic alloy shot fills the die cavity 24 as seen in FIG. 1B and quickly solidifies to form the casting 10. The total thermal energy content of the shot is half the total thermal energy content of a fully-liquid shot of the same temperature and is inadequate to melt the relatively cool, lower-melting temperature core 12. Hence, as seen in FIG. 1C, the core 12 is captive in the casting 10 after solidification.

Next, the core 12 is melted away from the casting 10 by heating the casting 10 and the captured core 12 to a temperature which is above the melting point of the core material and beneath the solid-to-semi-solid transition temperature of the thixotropic alloy of the casting 10. In the present example, the casting 10 is heated to a temperature of about 1,000° F. to melt the zinc alloy core 12, leaving a cast metal part 10 illustrated in FIG. 1D which has a very complex internal surface geometry including bores 30, threads 32, etc., and which requires no post-casting machining on its internal surfaces.

3. Practical Process

The basic process described in Section 2 above performs well in applications in which 1) the melting temperature of the core material is relatively close to the casting temperature of the thixotropic alloy shot, 2) the core has relatively few thin projections which could be subject to local heating upon casting, and/or 3) the shot is injected at relatively low velocities and high pressures compared to high pressure die casting. However, some enhancements of and refinements to the basic process are desirable in order to increase the process' reliability, versatility, and range of commercial applicability. A more detailed version of the basic process will now be described in conjunction with FIG. 2 and with simultaneous reference to FIGS. 1A–1D to describe structures usable in the process.

Figure 2:
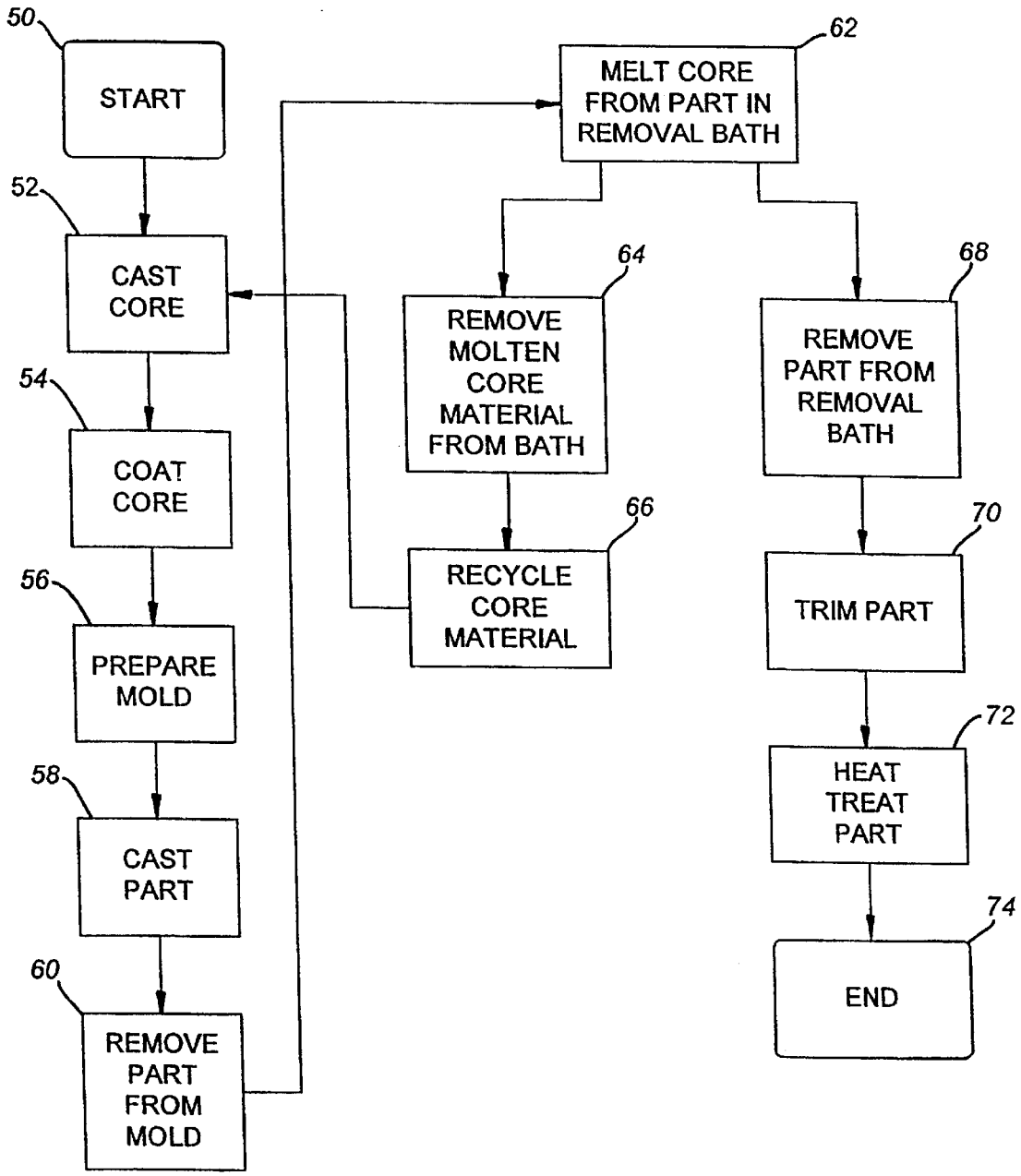
FIG. 2 is a flowchart of a preferred melt-away core precision casting process performed in accordance with the present invention.

The more detailed process proceeds from Start at Step 50 in FIG. 2 to Step 52 in which a core, such as the core 12 in FIGS. 1A–1C, is formed. The preferred properties of the core material depend to a large extent upon the thixotropic material of the casting because, inter alia, the core material should have a melting point relatively close—but still below—the solid-to-semi-solid transition temperature of the thixotropic alloy. The core material also should have a low affinity for the die material. Hence, zinc and zinc alloys are well-suited for use as a core material for a casting formed in steel dies from an aluminum alloy or magnesium alloy, whereas lead or a lead alloy are well-suited for use as a core material for a casting formed from a thixotropic zinc alloy. If a zinc-aluminum alloy is employed as the material for the core 12, the alloy of the core should have an aluminum content of less than 20%, and preferably less than 5%.

Most of the discussion that follows assumes that the thixotropic alloy of the casting 10 is a thixotropic aluminum alloy. A good candidate is the 356 T6 aluminum alloy, which is a bi-metal alloy containing aluminum and silicon. This alloy has a high tensile strength of 46 ksi, a high yield strength of 35 ksi, and an exceptional elongation of 12%, versus traditional die castings which typically have no more than about 1.5% elongation. This alloy is available from Ormet Primary Aluminum Corp., Hannibal, Ohio.

Assuming that the casting is to be formed from 356 T6 thixotropic aluminum alloy, another thixotropic aluminum alloy, or even a thixotropic magnesium alloy, a zinc or zinc alloy is the currently-preferred choice for core material. An especially-preferred material for use in the core has several characteristics.

First, the material of the core should have a melting point relatively close to the injection temperature of the shot which, in the case of a thixotropic aluminum alloy shot, is about 1080° F. to 1090° F. A melting point above 700° F. is preferred, and any material having a melting point of about 1000° F. but below 1080° F. to 1090° F. would be especially desirable.

The core material also should have a low affinity for the die material (iron in the present example) so as to increase the life of the dies used to cast the core 12. A material that permits the dies to survive 500,000 casting cycles, and preferably 1,000,000 casting cycles, is desirable. Alloying between the casting 10 and the dies 14 and 16 can similarly be avoided, with a commensurate increase in die life, by forming inserts for one or both of the dies 14 and 16 from the same material as the core 12. In this case, the insert(s) would simply be removed from the mold 18 with the casting 10 and the captured core 12, melted from the casting 10 when the core 12 is melted, and recycled. The preferred core material should be reusable to minimize material cost and should be capable of hot-chamber die-casting for high output. The preferred castable core should also have a smooth finish upon casting, preferably having a smoothness rating of below 125 microinches RA, and preferably of about 60 to 65 microinches RA. It also should be precision castable with tight tolerance, deforming less than 0.002 in/in, and preferably less than 0.0015 in/in. This feature also gives the process high repeatability. Finally, it should be capable of being cast with complex internal or external geometries in order to maximize design flexibility.

The core material also should be highly survivable during the casting process. Hence, it should be durable enough not to be damaged either in handling or during the casting process. It preferably has a tensile strength of at least 35 ksi, and even more preferably more than 40 ksi. It should have a high thermal capacity of above 0.08 Cal/per gram°C., and preferably above 0.10 Cal/gram°C. It should also be highly thermally conductive so as not to be prone to localized heating of any protrusion or any other localized portion. Thermal conductivity should be above 100 W/m°C. and preferably about 110 W/m°C.

In addition, the core material should be eutectic or nearly eutectic so as to transition nearly completely and instantaneously from solidus phase to liquidous phase to promote rapid and effective core removal when it is melted from the casting. A solid-to-liquid transition range of less than 20° F., and preferably less than 10° F., is preferred. The material also should have relatively high surface tension to promote separation of the core material from the cast metal part after the core melts.

The possibility of core melting can also be minimized by using a core in the process that is relatively massive relative to the casting. For instance, the ratio of the core volume to the casting volume could be 1:3 to 1:1. If smaller cores are required in a particular application, core melting can still be avoided by suitable control of one or more of the remaining parameters discussed above. These ratios are substantially lower than those required by prior known melt-away core casting processes described above.

A variety of zinc alloy materials meet at least the minimum acceptable threshold of each of these characteristics. These materials include AcuZinc 5 and ZAMAK 5. The currently-preferred material striking the best-known balance between all of these factors is ZAMAK 3, which is a zinc alloy containing between 3.5% and 4.3% aluminum and trace amounts of other metals including copper, magnesium, iron, and lead. It can be hot-chamber die-cast with high precision and very economically—well within the ranges described above. Moreover, because it has a relatively low aluminum content, it has a very low affinity for iron, permitting the dies 14 and 16 to survive more than 1,000,000 cycles of operation. ZAMAK 3 also is nearly eutectic, having a relatively low phase change range of between 718° F. and 728° F. It has a thermoconductivity of 113 W/m°C. and a tensile strength of 41 ksi. ZAMAK 3 is available, e.g., from the Fishercast Division of Fisher Gauge Limited, Peterborough, Canada.

Next, in Step 54, the core 12 (FIGS. 1A–1C) is coated to prevent zinc in the core from alloying with the aluminum in the shot and to reduce heat transfer to the core from the shot. Coating is not essential to the invention but adds considerable versatility because it permits shots to be injected about a core with very small protrusions at higher pressures and at higher velocities than otherwise would be possible. It also prevents abrasion of the core 12 when the shot is injected into the casting mold 18.

The preferred coating has several characteristics.

First, the coating should be capable of preventing alloying between the material of the core and the material of the casting. In the illustrated example in which a thixotropic aluminum alloy part is cast about a zinc alloy core, the coating prevents the semi-solid material of the shot from alloying with the core during the casting process and also prevents the liquid core material from alloying with the material of the casting 10 when the core 12 is melted from the casting 10.

Second, the coating should have at least limited thermal resistance or insulative capability. However, the insulative capability of the coating can be relatively low because only a relatively small amount of heat is available for transfer to the core due to the fact that the shot is formed from a semi-solid thixotropic material having low latent heat of solidification, and because the preferred core has high thermal conductivity and a melting point relatively close to the injection temperature of the shot. In practice, it is only necessary that the coating have a melting point which is no lower than the melting point of the core material and have a thermal conductivity which is no higher than that of the core material. This is in contrast to the Rearwin and Voss processes described above, in which the primary (if not sole) purpose of the coating was to act as a thermal barrier.

The coating also should be relatively thin and have a uniform thickness with a smooth finish. A thin coating is desirable so as not to noticeably affect the size or shape of the coated core relative to the uncoated core. A thickness of less than 0.0011", and preferably less than 0.0010" is preferred. A smooth finish is desirable so as not to disrupt the laminar flow of the shot around the core. Turbulent flow is undesirable because it increases abrasion of the coating from the flowing shot, risking coating failure. A smooth finish also promotes a corresponding smooth finish on the casting. A finish that is smooth to within 125 microinches, and preferably to within 60 microinches, is desirable. Uniformity of coating thickness is desirable both to avoid thin spots that could abrade through during casting and to promote uniform heat transfer to the entire core 12 so as to take advantage of the high thermal conductivity of the zinc alloy of the core. A coating thickness variation of less than ±0.0005", and preferably less than ±0.0002", is desirable. Finally, the coating should be relatively resistant to abrasion to prevent it from being worn away upon being contacted by the flowing shot. The material should be capable of withstanding 200, and preferably more than 1000, Tabor Abrasion Cycles at 500 gram loads.

Cost is also an issue. The preferred coating should have a low per-unit cost, a low capital requirement, and be easily incorporated into the casting process. The material cost of the coating should be less than 20% of the core cost, and preferably less than 5–10%. Its capital requirement should be less than 5¢ per cubic inch of core, and preferably less than 4¢ per cubic inch of core.

A variety of commercially-available coatings meet some or all of the above-described coating characteristics. An especially-preferred coating can be obtained simply by anodizing the core 12 after it is cast. Hence, in the case of a zinc core, the core can be coated through a zinc anodizing process. Zinc anodizing involves simply applying moderate voltage (on the order of 50 V) to 250 V to a weak acid bath (usually about 5% sulfuric or hydrochloric acid) into which the core is submerged. The resultant electrolysis forms a crystalline zinc oxide structure on the outer surface of the core 12. The coating is very thin (on the order of a few ten-thousandths of an inch) and is perfectly uniform in its thickness. In addition, being crystalline, it presents a high surface area that promotes adhesion with another coating, if an after-coat is desired. It serves as a barrier to alloying, both during casting and during core removal. It also highly resistant to abrasion, surviving more than 2000 Taber Abrasion Cycles at 500 gram loads if anodized to a charcoal or brown color. Zinc anodizing is also a very inexpensive process, requiring very little capital expenditure and very inexpensive materials. It is also easily integrated into a casting process. Those interested in the details of the zinc anodizing process are welcomed to refer to "Zinc Anodizing," Jacobson et al., *Metal Finishing*, June 1998 edition, the subject matter of which is incorporated by reference by way of background.

The anodized zinc layer, being formed from essentially the same material as the core itself, exhibits thermal resistance and thermal capacity characteristics which are only slightly better than those in the core. In high pressure applications, high shot velocity applications, or other applications in which these characteristics might be a concern, the anodized zinc layer can be after-coated with a thin layer of any commercially available insulative coating such as boron nitride, which has a very high melting point and which has a very low thermal conductivity when compared to zinc. Even with this after-coating, the total thickness of the combined layer is only a few ten-thousandths of an inch.

The invention is by no means limited to the above-described coating process. In many applications, the boron nitride or similar coating can be used in place of the zinc anodizing coating. Moreover, as discussed above, the coating step can be eliminated entirely if affinity of the core material for the die material or the casting material is not a concern, and if the application is one in which casting occurs at relatively low gate velocities.

Referring again to FIG. 2, the next Step 56 in the process is to prepare the mold 18 (FIG. 1B) for casting by spraying the dies 14 and 16 with a standard mold release agent and by inserting the core 12 into the dies 14 and 16, preferably by inserting them in datums such as the datums 20 and 22 in FIGS. 1A–1D in order to prevent the core 12 from moving or floating within the mold 18 upon the injection of the shot. The mold 18 is then closed to finish the preparation step.

Next, in Step 58, the metal part 10 is cast. Casting begins with the heating of an ingot of a thixotropic aluminum 356 alloy or another thixotropic alloy to its semi-solid phase using a standard induction heating pedestal or the like. The heated shot, having a gel-like consistency, can still be handled and transferred to the ram. The heated shot is then injected into the mold 18 through the inlet port 28 (FIG. 1B). The shearing effect of the ram causes the shot to become more liquid so that it has a consistency akin to that of toothpaste as it is injected into the mold 18. Injection preferably is controlled to maximize core survivability without sacrificing production rate or casting quality. Several factors are considered when designing this parameter of the process.

For instance, injection is controlled to maximize core survivability by suitable control of process temperature, shot velocity, shot pressure, and shot flow characteristics. For instance, the core should have an initial temperature of no more than 400° F. to 500° F. in order to permit the core 12 to receive some thermal energy without melting. In addition, the gate velocity should be low enough to minimize or eliminate core abrasion but high enough to assure that the die cavity 24 is filled before the shot begins to harden. The gate velocity preferably should be between 50 in/sec and 100 in/sec, and even more preferably between 75 in/sec and 90 in/sec. The shot should be injected at a relatively high pressure akin to that found in the squeeze casting process. In this example, the intensification pressure within the cavity should be between 22,000 psi and 30,000 psi, and even more preferably of about 29,400 psi. Acceptable pressures and velocities can be increased by tailoring gate configurations and orientations to reduce the force with which the shot impinges on the core 12. Preferably, the gate should be located relative to the core 12 such that incoming materials tend to flow laminarily around the core rather than impinging on the core at or near a right angle.

The shot also should solidify as quickly as possible so as to reduce the possibility of core damage. It is preferred that the shot solidify in less than 0.4 seconds, and even more preferably in less than 0.2 seconds. This is not a problem in most thixotropic casting processes.

Referring again to FIG. 2, after the shot solidifies to form the casting 10, the mold is opened, and the casting 10 and its captured core 12 are removed in Step 60.

The only substantive remaining step in the process is to melt the core 12 from the casting 10. Any process that results in heating of the casting 10 and the core 12 to a temperature above the melting point of the core material but below the solid-to-semi-solid transition temperature of the thixotropic alloy of the casting 10 would suffice. Preferably, core melting is controlled to permit the core material to be recycled and to assure complete removal of the core material from the finished casting 10. For instance, the core 12 could be melted in an air furnace or during heat treatment of the casting 10. However, a preferred core removal process is that which 1) conserves energy by reheating a still-hot, freshly formed casting, 2) melts the core quickly, preferably in less than 10 seconds, so as not to slow the casting cycle, and 3) completely removes the core 12 without leaving any core residue or bath agent on the casting 10.

These goals can be achieved admirably in a liquid bath melting process. In this process, the casting 10 and its captured core 12 are submerged in a liquid bath at a temperature above the melting point of the core 12 (Step 62) to melt the core, and the casting 10 is then removed from the bath (Step 68). Preferably, the molten core material can be drained or skimmed from the bath (Step 64) and then recycled (Step 66) to form at least part of another core.

It is preferred that the liquid of the bath have several characteristics. First, in order to maximize heat transfer efficiency, the bath should be formed from material of relatively high thermal conductivity and should have a mass that is orders of magnitude greater than the mass of the core 12. The bath material also should have a density somewhat close to that of the liquid core material so that the liquid core material has only slight negative or positive buoyancy in the bath. Where this slight buoyancy is present, the surface tension of the liquid material from the melted core liquid tends to pull all liquid core material from the casting 10, leaving a very clean casting 10.

Figure 3:
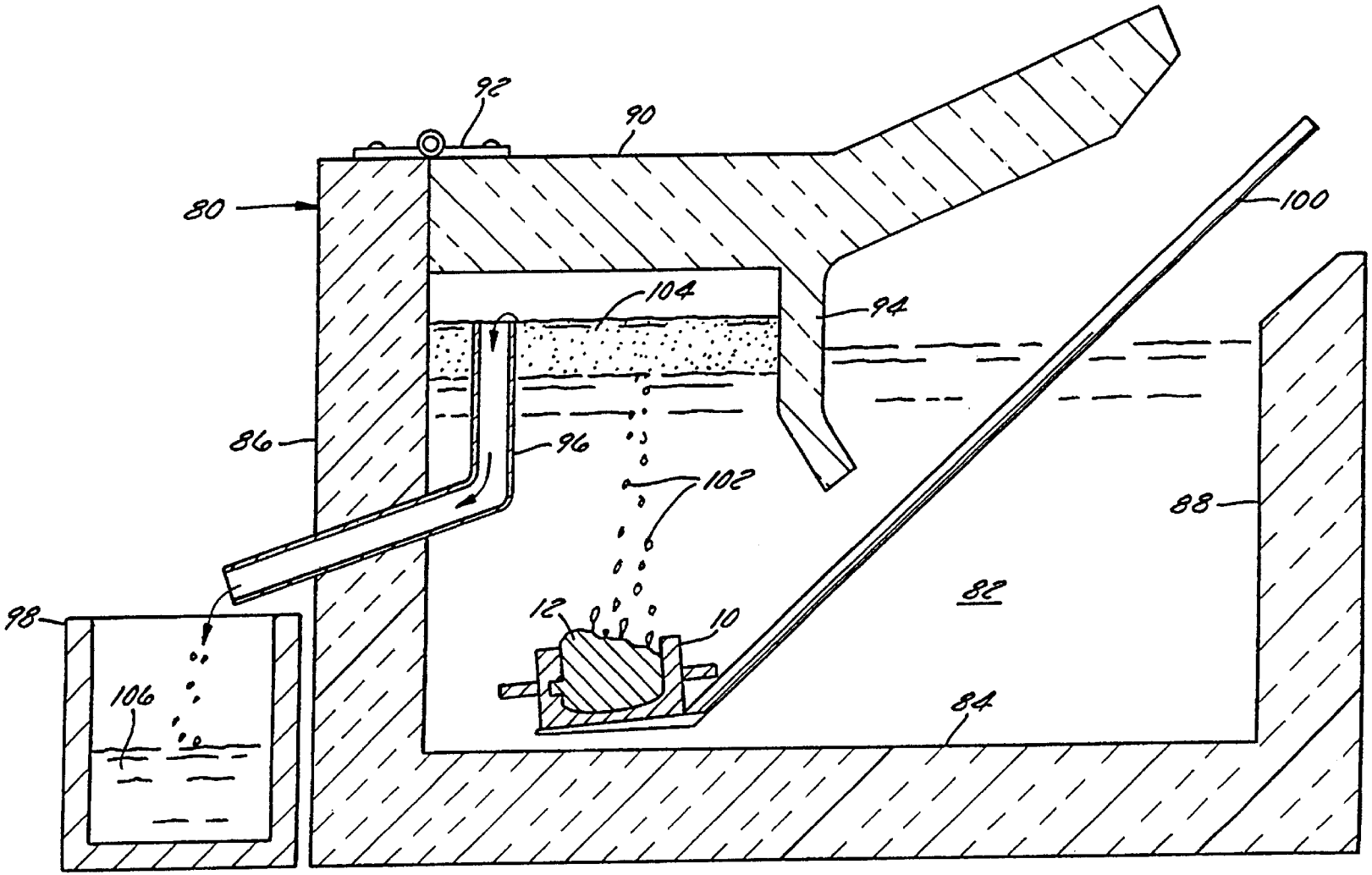
FIG. 3 is a somewhat-schematic, sectional side elevation view of a liquid bath depicting the manner in which the bath is used to melt a core from a casting produced in accordance with the present invention.

An apparatus well-suited for core removal by submersion in a liquid bath is illustrated in FIG. 3. This apparatus includes a submersion tank 80 formed from a refractory material and containing a liquid 82 heated to a core melting temperature above the melting point of the core material but beneath a temperature at which the thixotropic alloy of the casting 10 begins to transition to its semi-solid phase. In the illustrated example in which the ZAMAK 3 material of the core 12 melts at less than about 800° F. and the thixotropic alloy of the casting 10 starts to liquify at 1080° F. to 1090° F., the liquid 82 preferably is heated to a temperature of about 900° F. to 1000° F. The liquid 82 preferably comprises lead because 1) lead is a liquid at these temperatures, 2) liquid zinc has a relatively slight positive buoyancy compared to liquid lead, and 3) lead has little affinity for aluminum.

Still referring to FIG. 3, the tank 80 includes a floor 84, a front wall 86, and a rear wall 88. A cover 90 extends partway across the tank 80 from the front wall 86 toward the rear wall 88 so as to leave a relatively small opening near the rear wall 88 for the insertion or removal of cast parts. The cover 90 is attached to the front wall 86 by a hinge 92 that permits the cover 90 to be selectively opened to fill or empty the tank 80. A baffle 94 extends downwardly from the cover 90 into the interior of the liquid 82 to define 1) a zinc recovery zone between the baffle 94 and the front wall 86 of the tank 80 and 2) a casting insertion/removal zone between the baffle 94 and the rear wall 88 of the tank 80. A heated zinc alloy drain tube 96 extends from the zinc recovery zone, through the front wall 86 of the tank 80, and into a heated zinc recovery tank 98.

In use, a freshly-cast part 10 and its captured core 12 are removed from the mold 18 (FIG. 1B) via an apparatus, such as tongs 100, and transferred directly to the tank 80 so that the part 10 and core 12 are still at a temperature of about 400° F. to 600° F. when they are inserted into the molten lead 82 and positioned at the illustrated location within the zinc recovery zone. The core 12, having high thermal conductivity and preferably being eutectic or nearly eutectic in its melting range, rapidly melts (due in part to the high thermal conductivity of the liquid bath material), releases from the casting 10, and rises to the surface of the molten lead 82. While the melting material is depicted as rising in discrete bubbles 102 for descriptive purposes, the material likely would rise as nearly a continuous mass due to the fact that the entire core 12 melts essentially simultaneously. Separation of the material of the core from the casting 10 can be enhanced by slightly agitating the casting 10, e.g., by tilting it from side-to-side while the core 12 melts. As the zinc alloy from the core 12 melts, it rises to the surface of the molten lead 82 and forms a layer 104 of molten zinc alloy. As the depth of layer 104 increases, molten zinc alloy flows through the zinc alloy drain tube 96 and into the zinc recovery tank 98, where it collects in a pool 106 and can be periodically retrieved and recasted in other cores. Boron nitride or another thermal barrier coating, if present on the core 12, rises with the zinc alloy and floats on top of the zinc alloy layer 104. This material can be periodically skimmed from the top of the zinc alloy layer 104 via any conventional process without adversely affecting the quality of the recovered zinc alloy.

After the entire core 12 has melted and released from the casting 10 (typically occurring over a period of no more than one-to-five seconds), the operator simply withdraws the casting 10 from the tank 80, at which point the tank 80 is ready to receive the next casting.

Other baths than the bath of molten lead 82 could be used to melt the core from the casting 10. For instance, the lead bath could be replaced by a salt bath or an oil bath, in which case the melted core metal would have negative buoyancy relative to the liquid of the bath and would sink. In this case, the casting 10 would be submerged in the bath in an inverted position rather than the upright position illustrated in FIG. 3. Minor structural alterations to the submersion tank 82 of FIG. 3 also would be required to accommodate a low-density bath. These modifications include 1) the replacement of the downwardly-extending baffle 94 with a baffle extending upwardly from the bottom 84 of the tank 82, and 2) the replacement of the zinc alloy drain tube 96 with an apparatus capable of removing the liquid core material from the bottom 84 of the tank 82.

Referring again to FIGS. 1D and 2, after the casting 10 is removed from the bath, it is completely free of core material and is nearly finished. It is only necessary to trim shot gates off the casting 10 in a conventional manner (Step 70) and to heat treat or solution age the casting 10 in a conventional manner (Step 72). The resultant cast metal part is now ready to use in virtually any desired application. No machining is required because the part, having been formed by the inventive melt-away core molding process, is essentially pore-free and has been cast with extremely tight tolerances, with the inner surface of the part maintaining the initial shape of the core to within 0.0015 inches per measured inch of the inner surface of the casting 10, and possibly to within 0.0005 inches per inch or even less. The part is suitable, without being machined, for use as brake calipers or any of a number of other castings requiring the use of precision cast parts. These other castings include, but are not limited to: engines, manifolds, transmission housings, axle housings, and golf clubs.

Preferably, the process of FIG. 2 is controlled such that the entire process can be repeated continuously in cycles of 20–40 seconds, and possibly at cycles of less than 20 seconds and even less than 10 seconds. These production rates are possible by controlling the process parameters as described in the preceding paragraphs.

4. Practical Applications

Figure 4:
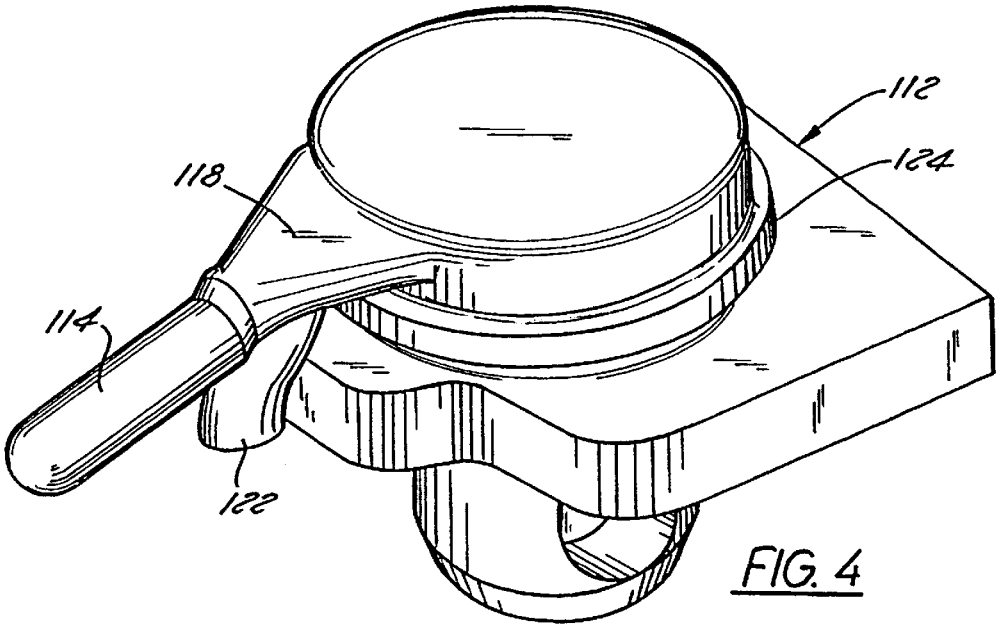
FIG. 4 is a perspective view illustrating another core usable in a casting process performed in accordance with the present invention.
Figure 5:
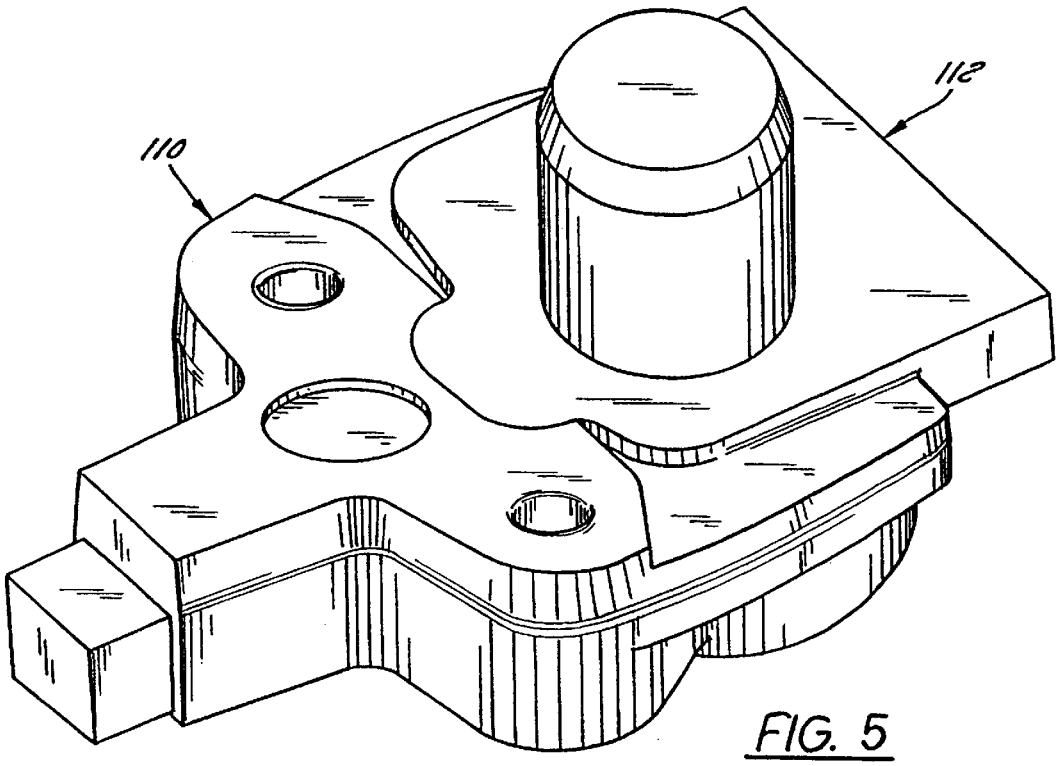
FIG. 5 is a perspective view of the core of FIG. 4 and of the associated casting.
Figure 6:
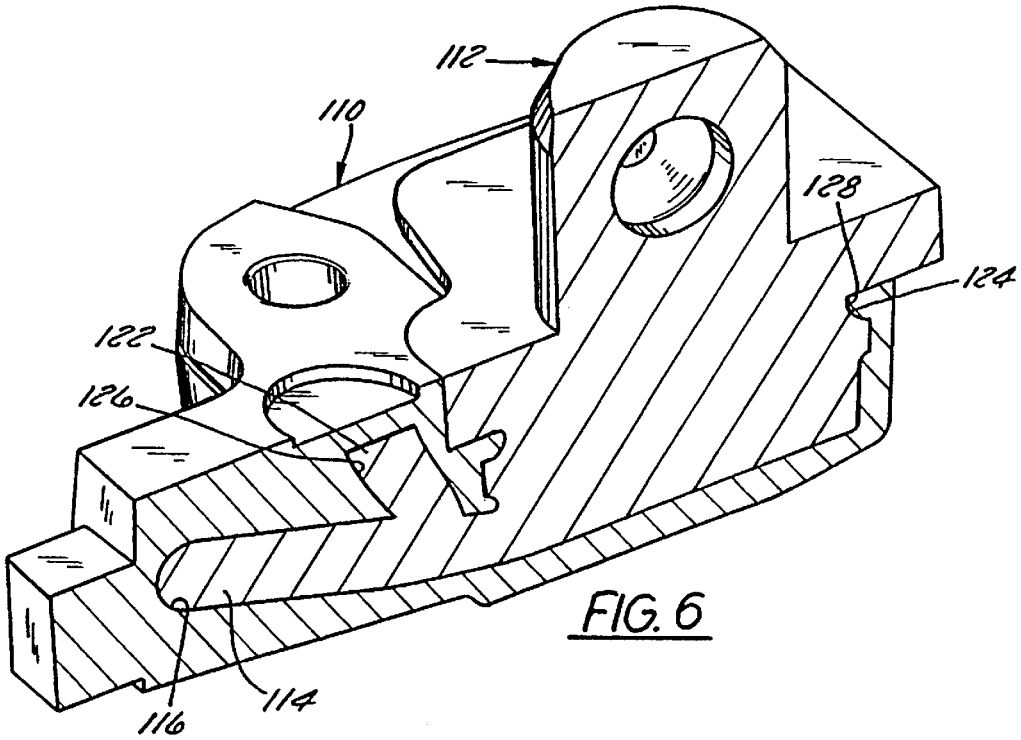
FIG. 6 is a sectional side view of the core and casting combination of FIG. 5.
Figure 7:
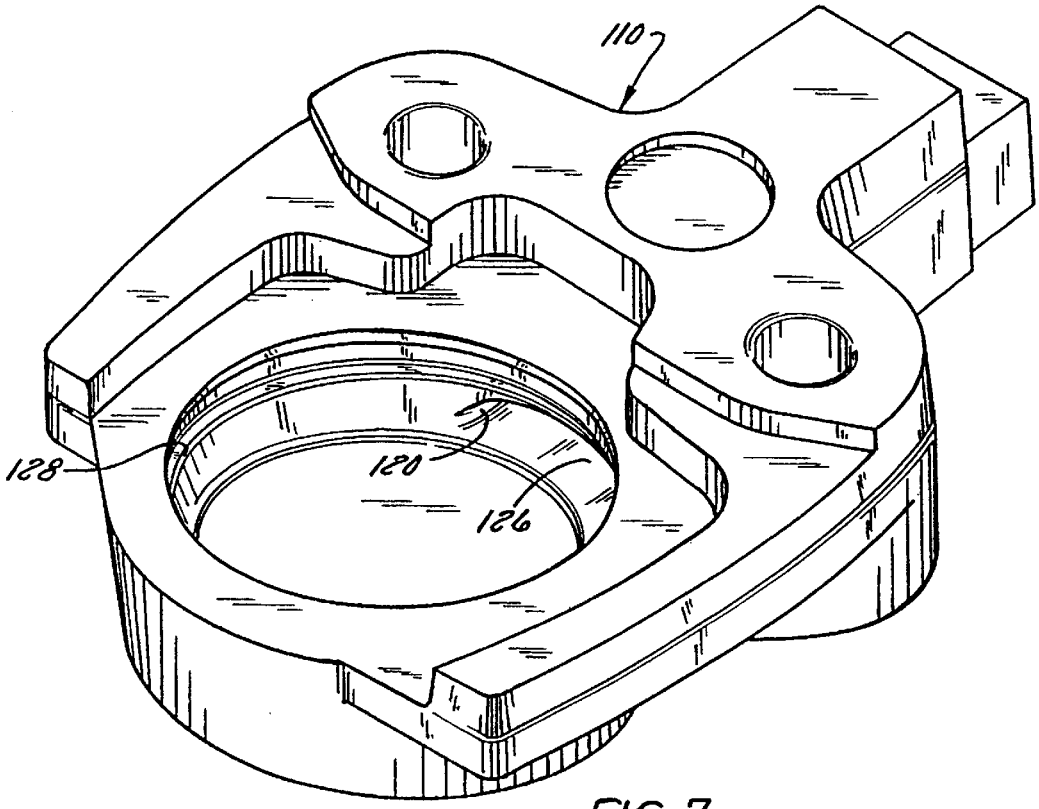
FIG. 7 is a perspective view of the casting of FIGS. 5 and 6, illustrating the appearance of the casting after the core has been removed.

The versatility and range of applications of the present invention can best be understood by way of some practical examples. An exemplary cast metal part 110 producable by the inventive process is a brake caliper illustrated in FIG. 7. A complex core 112 usable in that caliper is illustrated in FIG. 4 and is illustrated as being captured by the caliper 110 in FIGS. 5 and 6. The core 112 includes distinct protrusions including a first protrusion 114 which produces a bore 116 in the finished caliper 110 and a second protrusion 118 which produces an undercut 120 in the finished caliper 110. Other protrusions 122 and 124 produce a port 126 and a seal groove 128 in the finished caliper 110, respectively. Although not present in the illustrated caliper 110, it is also possible to use the inventive process to produce fine features such as fine threads on the casting. In fact, the invention has been used to produce threads on a casting having a pitch of 40 threads/in. Traditional mechanically-removed cores simply cannot be formed with these complex shapes. It would also be difficult or impossible to form these complex shapes using salt cores or other cores used in other lost core casting processes. Nor could these other lost core processes be used to produce parts that do not require any subsequent machining. It is believed that even other prior proposed melt-away core casting processes, such as those disclosed in the Pack, Rearwin, Drury, and Voss patents, could not employ cores of these complex shapes and still produce precision-cast parts requiring no subsequent machining.

Figure 8:
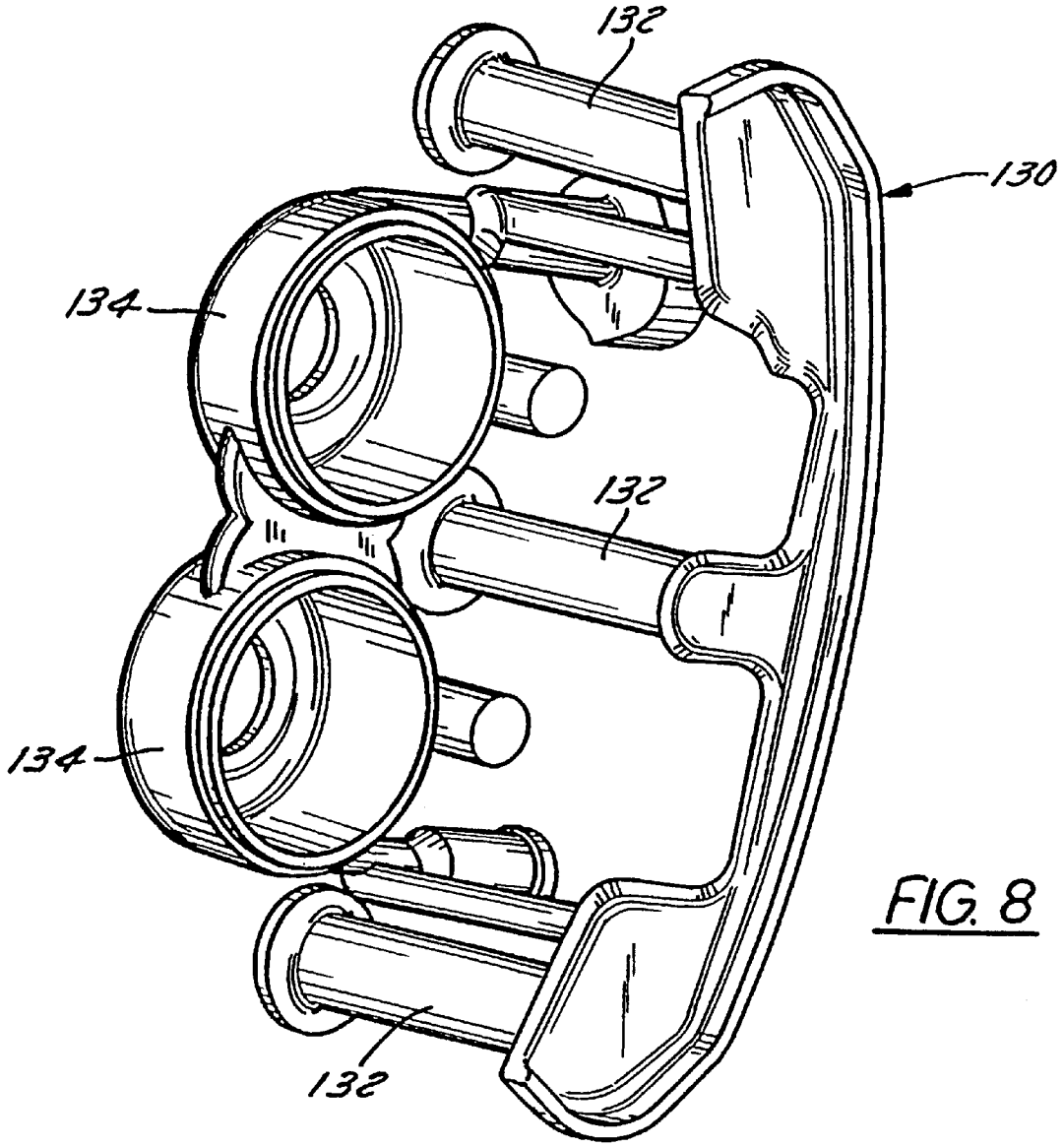
FIG. 8 is a perspective view of another core usable to produce a brake caliper using the inventive melt-away core precision casting process.

An extreme, though highly viable, example of a core 130 usable in the inventive process is illustrated in FIG. 8. Core 130 is used to produce an outer housing for a front brake caliper usable in motorcycles or the like. The complex geometries of this core, including stepped protrusions 132, cups 134, and other complex structures, could not be used in any previously-known casting process while still producing a precision-cast part.

The elimination of the machining requirement for cast parts, coupled with the ability to reuse the retrieved core material in subsequent cores, dramatically reduces manufacturing costs. For instance, the illustrated brake caliper 130 historically would cost about $2.50 to cast at current market rates and another $5.00 to machine. The inventive process can produce the same part for a total cost of less than $3.00—a 60% cost reduction on a per-part basis. Savings become more dramatic when one takes into account the fact that the capital cost of the process can be reduced from $4.5 million to $1.0 million or even less given the fact that lathes, drills, and other machines that would otherwise have to be purchased to machine the cast parts can be eliminated due to the elimination of the post-casting machine requirement.

Many changes and alterations may be made to the present invention without departing from the spirit thereof. The scope of some of these changes are discussed above. The scope of other changes will become apparent from the appended claims.

I claim:

1. A precision casting process comprising:

(A) placing a metal core in a mold while retaining a die cavity between said core and an inner surface of said mold; then (B) filling said die cavity with a shot of a semi-solid thixotropic alloy at a temperature higher than a melting point of the metal of said core; then (C) allowing said shot to cool and solidify, thereby forming a casting; then (D) melting said core from said casting.

2. A process as defined in claim 1, wherein said process comprises one of 1) casting a thixotropic aluminum alloy shot about a zinc core or a zinc alloy core, 2) casting a thixotropic magnesium alloy shot about a zinc core or a zinc alloy core, and 3) casting a thixotropic zinc alloy shot about a lead core.

3. A process as defined in claim 1, wherein said process comprises casting a thixotropic aluminum alloy shot about a zinc core or a zinc alloy core.

4. A process as defined in claim 3, wherein said core is formed from a eutectic or nearly-eutectic zinc alloy.

5. A process as defined in claim 4, wherein said core is formed from ASTM AG 40A zinc alloy.

6. A process as defined in claim 1, wherein said shot is at least 50% solid by volume when it is introduced into said mold.

7. A process as defined in claim 1, wherein said core is a cast core having a tensile strength of over 35 ksi, a thermal capacity of over 100 W/m°C., and a thermal capacity of over 0.08 Cal/g°C.

8. A process as defined in claim 1, wherein said core has protrusions which result in the formation of at least one of an undercut, threads, and a bore in an inner surface of said casting.

9. A process as defined in claim 1, wherein said core and said casting have a ratio of core mass to casting mass of between 1:3 and 1:1.

10. A process as defined in claim 1, further comprising coating said core prior to placing said core in said mold.

11. A process as defined in claim 10, wherein the coating step comprises at least one of 1) coating a material onto said core, and 2) anodizing a surface of said core.

12. A process as defined in claim 11, wherein the coating step comprises first anodizing said surface of said core to produce an anodized layer, then overcoating said anodized layer with said material.

13. A process as defined in claim 10, wherein the coating step comprises coating said core with a material capable of withstanding at least 200 Taber Abrasion Cycles at a 500 gram load.

14. A process as defined in claim 13, wherein the coating step comprises coating said core with a material capable of withstanding at least 2,000 Taber Abrasion Cycles at a 500 gram load.

15. A process as defined in claim 10, wherein the coating step comprises coating said core with boron nitride.

16. A process as defined in claim 1, wherein the melting step comprises submerging said casting and said core in a liquid bath which is heated to above the melting point of the material of said core.

17. A process as defined in claim 16, wherein the liquid of said bath has a higher density than liquid metal from said core, and wherein said casting and said core are submerged in said bath in an upright position permitting the liquid metal from said core to rise to a surface of said bath.

18. A process as defined in claim 16, wherein said bath is a metal bath.

19. A process as defined in claim 18, wherein said core is formed from a zinc alloy and said bath is a lead bath.

20. A process as defined in claim 16, wherein the liquid of said bath has a lower density than liquid metal from said core, and wherein said casting and said core are submerged in said bath in an inverted position permitting the liquid metal from said core to sink to a bottom of said bath.

21. A process as defined in claim 20, wherein said bath is one of a salt bath and an oil bath.

22. A process as defined in claim 1, wherein the melting step comprises heat treating or solution aging said casting.

23. A process as defined in claim 1, further comprising, after the melting step, recycling the liquid metal from said core and forming at least part of another core from the liquid metal.

24. A process as defined in claim 1, wherein, following the melting step, an inner surface of said casting is essentially pore-free.

25. A process as defined in claim 1, wherein, following the melting step, an inner surface of said casting retains the initial shape of said core to within 0.0005 inches per inch of measured length of the casting inner surface.

26. A process as defined in claim 1, wherein said core is formed from a metal that is at least nearly eutectic.

27. A precision casting process comprising:

(A) placing a metal core in a mold while retaining a die cavity between said core and an inner surface of said mold; then (B) filling said die cavity with a shot of a semi-solid thixotropic alloy at a temperature higher than a melting point of the metal of said core; then (C) allowing said shot to cool and solidify, thereby forming a casting; then (D) melting said core from said casting, wherein said process comprises casting a thixotropic aluminum alloy shot about a zinc core or a zinc alloy core, and wherein said shot is introduced into said hold at a temperature of between 1,050° F. and 1,100° F., an intensification pressure of between 22,000 psi and 30,000 psi, and a gate velocity of between 50 in/sec and 100 in/sec.

28. A process as defined in claim 27, wherein said shot is introduced into said mold at a temperature of about 1,080° F., an intensification pressure of about 29,400 psi, and a gate velocity of between 70 in/sec and 90 in/sec.

29. A precision casting process comprising:

(A) placing a metal core in a mold while retaining a die cavity between said core and an inner surface of said mold; then (B) filling said die cavity with a shot of a semi-solid thixotropic alloy at a temperature higher than a melting point of the metal of said core; then (C) allowing said shot to cool and solidify, thereby forming a casting; then (D) melting said core from said casting, wherein
said shot is at least 50% solid by volume when it is introduced into said mold, and wherein
said shot is at least 60% solid by volume when it is introduced into said mold.

30. A precision casting process comprising:

(A) placing a metal core in a mold while retaining a die cavity between said core and an inner surface of said mold; then (B) filling said die cavity with a shot of a semi-solid thixotropic alloy at a temperature higher than a melting point of the metal of said core; then (C) allowing said shot to cool and solidify, thereby forming a casting; then (D) melting said core from said casting, wherein
said core has protrusions which result in the formation of at least one of an undercut, threads, and a bore in an inner surface of said casting.

31. A precision casting process comprising:

(A) placing a metal core in a mold while retaining a die cavity between said core and an inner surface of said mold; then (B) filling said die cavity with a shot of a semi-solid thixotropic alloy at a temperature higher than a melting point of the metal of said core; then (C) allowing said shot to cool and solidify, thereby forming a casting; then (D) melting said core from said casting,
wherein said core and said casting have a ratio of core mass to casting mass of between 1:3 and 1:1.

32. A precision casting process comprising:

(A) coating a metal core with a coating material; then (B) placing a metal core in a mold while retaining a die cavity between said core and an inner surface of said mold; then (C) filling said die cavity with a shot of an semi-solid thixotropic alloy at a temperature higher than a melting point of the metal of said core; then (D) allowing said shot to cool and solidify, thereby forming a casting; then (E) melting said core from said casting, wherein the coating step comprises coating said core with a coating which 1) is less than 0.0015" thick, 2) is smooth to within about 125 microinches, and 3) has a uniform thickness to within about 0.0005".

33. A process as defined in claim 32, wherein the coating step comprises coating said core with a coating which 1) is less than 0.0010" thick, 2) is smooth to within about 60 microinches and 3) has a uniform thickness to within about 0.0002".

34. A precision casting process comprising:

(A) placing a metal core in a mold while retaining a die cavity between said core and an inner surface of said mold; then (B) filling said die cavity with a shot of a semi-solid thixotropic alloy at a temperature higher than a melting point of the metal of said core; then (C) allowing said shot to cool and solidify, thereby forming a casting; then (D) melting said core from said casting, wherein, following the melting step, an inner surface of said casting retains the initial shape of said core to within 0.0005 inches per inch of measured length of the casting inner surface.

35. A precision casting process comprising:

(A) placing a metal core in a mold while retaining a die cavity between said core and an inner surface of said mold; then (B) filling said die cavity with a shot of a semi-solid thixotropic alloy at a temperature higher than a melting point of the metal of said core; then (C) allowing said shot to cool and solidify, thereby forming a casting; then (D) melting said core from said casting, wherein said mold includes a pair of dies which face one another to form said die cavity, and wherein a die insert is inserted in one of said dies, is formed from a material having a melting point which is lower than a solid-to-semi-solid transition temperature of said thixotropic alloy, and has a lower affinity than said thixotropic alloy for the material of said dies, and further comprising removing said insert from said mold with said casting following the cooling step and melting said insert during the core melting step.

36. A process comprising melting a metal core from a thixotropic alloy cast metal part by heating said part and said core to a core melting temperature above a melting point of a metal of said core but beneath a solid-to-semi-solid transition temperature of said thixotropic alloy.

37. A process as defined in claim 36, wherein the melting step comprises submerging said part in a liquid bath which is heated to said core melting temperature, and further comprising removing said cast metal part from said liquid bath after said core melts and liquid metal from said core separates from said cast metal part.

38. A process as defined in claim 37, wherein the liquid of said bath has a lower density than the liquid metal from said core, and wherein said cast metal part is submerged in said bath in an inverted position permitting the liquid metal from said core to sink to a bottom of said bath.

39. A process as defined in claim 38, wherein said bath is one of a salt bath and an oil bath.

40. A process as defined in claim 36, wherein the melting step comprises heat treating or solution aging said cast metal part.

41. A process as defined in claim 36, wherein the melting step comprises heating said cast metal part in an air furnace.

42. A process as defined in claim 36, further comprising recycling the liquid metal from said core and forming at least part of another core from the liquid metal.

43. A process comprising melting a metal core from a thixotropic alloy cast metal part by heating said part and said core to a core melting temperature above a melting point of a metal of said core but beneath a solid-to-semi-solid transition temperature of said thixotropic alloy, wherein the melting step comprises submerging said part in a liquid bath which is heated to said core melting temperature, and further comprising removing said cast metal part from said liquid bath after said core melts and liquid metal from said core separates from said cast metal part, and wherein the liquid of said bath has a higher density than the liquid metal from said core, and wherein said cast metal part is submerged in said bath in an upright position permitting the liquid metal from said core to rise to a surface of said bath.

44. A process as defined in claim 43, wherein said bath is a metal bath.

45. A process as defined in claim 44, wherein said core is formed from a zinc alloy and said bath is a lead bath.

46. A process comprising melting a metal core from a thixotropic alloy cast metal part by heating said part and said core to a core melting temperature above a melting point of a metal of said core but beneath a solid-to-semi-solid transition temperature of said thixotropic alloy, wherein the melting step comprises submerging said part in a liquid bath which is heated to said core melting temperature, and further comprising removing said cast metal part from said liquid bath after said core melts and liquid metal from said core separates from said cast metal part, and wherein the liquid of said bath is contained in a tank having 1) a bottom surface, 2) an upper inlet at a first end thereof, 3) a core liquid collection zone at a second end thereof, 4) a baffle extending into said liquid bath at a location between said first and second ends, and 5) a drain, located between said baffle and said second end of said tank, for removing the liquid metal from said core from said bath.

47. A precision casting process comprising:

(A) placing a metal core in a mold while retaining a die cavity between said core and an inner surface of said mold, said core having surface structures including at least one of protrusions and indentations on an outer surface thereof; then (B) filling said die cavity with a semi-solid thixotropic alloy shot at a temperature higher than a melting point of the metal of said core; then (C) allowing said shot to cool and solidify, thereby forming a casting having a captured core; then (D) melting said core from said casting to leave a casting that has surface structures having shapes that complement the shapes of said surface structures on said core, said surface structures on said core and said surface structures on said casting preventing mechanical removal of said core from said casting.

48. A process as defined in claim 47, wherein, following the melting step, an inner surface of said casting is essentially pore-free.

49. A process as defined in claim 47, wherein, following the melting step, an inner surface of said casting retains the initial shape of said core to within 0.0015 inches per inch of measured length of the casting inner surface.

50. A process as defined in claim 47, wherein, following the melting step, an inner surface of said casting retains the initial shape of said core to within 0.0005 inches per inch of measured length of the casting inner surface.

51. A precision casting process comprising:

(A) casting a metal core from a zinc alloy comprising one of ASTM AC 41A zinc alloy and ASTM AG 40A zinc alloy, said core having protrusions on an outer surface thereof; then (B) coating said core with an insulating, abrasion-resistant material comprising at least one of an anodized layer of said metal core and a coating of another material; then (C) placing said metal core in a mold while retaining a die cavity between said core and an inner surface of said mold; then (D) filling said die cavity with a shot of a semi-solid thixotropic aluminum alloy at a temperature higher than a melting point of the metal of said core, said shot being at least 60% solid by volume; then (E) allowing said shot to cool and solidify, thereby forming a cast metal part with a captured core; then (F) melting said core from sail part in a heated liquid bath to leave a metal part that has at least one of threads, an undercut, and a bore formed from said protrusions on said outer surface of said core.

52. A process as defined in claim 51, wherein, following the melting step, an inner surface of said part is essentially pore-free.

53. A process as defined in claim 51, wherein, following the melting step, an inner surface of said part retains the initial shape of said core to within 0.0005 inches per inch of measured length of the casting inner surface.

54. A precision casting process comprising:

(A) hot die casting a metal core from ASTM AG 40A zinc alloy, said core having protrusions on an outer surface thereof; then (B) anodizing an outer layer of said core; then (C) over coating said core with a layer of boron nitride; then (D) placing said core in a mold while retaining a die cavity between said core and an inner surface of said mold; then (E) filling said die cavity with a shot of a semi-solid thixotropic aluminum 356 T6 alloy at a temperature of about 1080° F. to 1090° F., said shot being 60% solid by volume; then (F) allowing said shot to cool and solidify, thereby forming a cast metal part having a captured core; then (G) melting said core from said part in a bath of liquid metal, heated to a temperature of at least 750° F., thereby leaving a part that has at least one of threads, an undercut, and a bore formed from said protrusions on said outer surface of said core, an inner surface of said part being essentially pore-free and having a linear dimensional tolerance of at least about 0.0015 in/in; then (H) removing said part from said bath and allowing said part to cool; then (I) solution aging said part; and (J) removing the liquid metal from said core from said bath, and recycling said liquid metal from said core to form at least part of another core.

55. A process as defined in claim 54, wherein said mold includes a pair of dies which face one another to form said die cavity, and wherein a die insert is inserted in one of said dies, is formed from a material having a melting point which is lower than a solid to semi-solid transition temperature of said thixotropic alloy, and has a lower affinity than said thixotropic alloy for the material of said dies.

56. A precision casting process comprising:

(A) coating a metal core with a coating material; then (B) placing a metal core in a mold while retaining a die cavity between said core and an inner surface of said mold; then (C) filling said die cavity with a shot of a semi-solid thixotropic alloy at a temperature higher than a melting point of the metal of said core; then (D) allowing said shot to cool and solidify, thereby forming a casting; then (E) melting said core from said casting, wherein the coating step comprises coating said core with a coating which is less than 0.0015" thick.

57. A process as defined in claim 56, wherein said coating is smooth to within about 125 microinches.

58. A process as defined in claim 56, wherein said coating has a uniform thickness to within about 0.0005".

59. A precision casting process comprising:

(A) placing a metal core in a mold while retaining a die cavity between said core and an inner surface of said mold; then (B) filling said die cavity with a shot of a semi-solid thixotropic alloy at a temperature higher than a melting point of the metal of said core but lower than a melting point of a highest-melting point constituent of said alloy; then (C) allowing said shot to cool and solidify, thereby forming a casting; then (D) melting said core from said casting.

* * * * *